US008997308B2

(12) United States Patent
Cortes Ruiz et al.

(10) Patent No.: US 8,997,308 B2
(45) Date of Patent: Apr. 7, 2015

(54) WET/DRY VACUUM CLEANER

(75) Inventors: Marco Antonio Cortes Ruiz, Cuautitlan Izcalli (MX); Felix Rodriguez Perfino, Cuautitlan Izcalli (MX); Richard Arthur Kohler, Cuautitlan Izcalli (MX)

(73) Assignee: Koblenz Electricia S.A. de C.V. (MX)

( * ) Notice: Subject to any disclaimer, the term of this patent is extended or adjusted under 35 U.S.C. 154(b) by 50 days.

(21) Appl. No.: 13/556,446

(22) Filed: Jul. 24, 2012

(65) Prior Publication Data

US 2014/0026355 A1 Jan. 30, 2014

(51) Int. Cl.

| | |
|---|---|
| ***A47L 9/18*** | (2006.01) |
| ***A47L 7/00*** | (2006.01) |
| ***A47L 9/00*** | (2006.01) |
| ***A47L 9/24*** | (2006.01) |

(52) U.S. Cl.

CPC ..... *A47L 7/0004* (2013.01); *A47L 7/0042* (2013.01); *A47L 9/009* (2013.01); *A47L 9/242* (2013.01); *Y10S 55/03* (2013.01)

(58) Field of Classification Search

CPC ..... A47L 9/18–9/188; A47L 7/0004–7/0042
USPC ..... 15/327.1, 327.6, 347, 353; 210/457, 210/416.1, 493.1, 493.2, 493.5; 96/333, 33, 96/338, 339, 337; 55/DIG. 3; 16/29, 30
See application file for complete search history.

(56) References Cited

U.S. PATENT DOCUMENTS

| | | | | |
|---|---|---|---|---|
| 2,137,560 | A | | 11/1938 | Anderson |
| 2,716,465 | A | * | 8/1955 | Meyerhoefer ..... 55/356 |
| 3,668,842 | A | | 6/1972 | Batson et al. |
| 3,732,667 | A | | 5/1973 | Fromknecht et al. |
| 3,943,591 | A | | 3/1976 | Lanusse |
| 4,072,483 | A | * | 2/1978 | Doyle, Jr. ..... 55/372 |
| 4,086,680 | A | | 5/1978 | Kelly |
| 4,105,421 | A | | 8/1978 | Rheinfrank, Jr. et al. |
| 4,142,270 | A | * | 3/1979 | Nauta ..... 15/353 |
| 4,179,768 | A | | 12/1979 | Sawyer |
| 4,266,954 | A | | 5/1981 | Oare et al. |
| 4,466,155 | A | * | 8/1984 | Grave ..... 15/321 |
| 4,538,971 | A | | 9/1985 | Miller et al. |
| 4,731,184 | A | | 3/1988 | Ostreicher et al. |
| 5,061,303 | A | | 10/1991 | Williams et al. |
| 5,313,686 | A | | 5/1994 | Berfield |
| 5,408,722 | A | * | 4/1995 | Berfield ..... 15/327.2 |
| 5,440,780 | A | | 8/1995 | Rakocy et al. |
| 5,535,500 | A | | 7/1996 | Stephens et al. |
| 5,606,769 | A | | 3/1997 | Tomasiak et al. |
| 5,664,283 | A | | 9/1997 | Rakocy et al. |
| 5,733,351 | A | | 3/1998 | Hult et al. |
| 5,783,086 | A | | 7/1998 | Scanlon et al. |
| 5,795,358 | A | * | 8/1998 | Scanlon et al. ..... 55/320 |
| 5,855,634 | A | | 1/1999 | Berfield |
| 5,924,165 | A | | 7/1999 | Gierer et al. |
| 5,954,863 | A | | 9/1999 | Loveless et al. |
| 6,003,200 | A | | 12/1999 | Potts et al. |
| 6,079,076 | A | * | 6/2000 | Berfield ..... 15/321 |

(Continued)

*Primary Examiner* — Mark Spisich
*Assistant Examiner* — Andrew A Horton
(74) *Attorney, Agent, or Firm* — Greenberg Traurig, LLP

(57) ABSTRACT

A wet/dry vacuum cleaner having a cover closing off the upper end of the vacuum cleaner, a lid connected to the cover having a collector extending into the lid and a filter assembly extending downwardly from the collector into water tank, the lid having an exhaust port for the vacuum cleaner communicating with a exterior thereof.

A volute is disposed internally of the lid and coupled to the exhaust port, the volute being generally horizontally mounted in the lid forming a flat volute for accumulating air flow.

8 Claims, 13 Drawing Sheets

(56) References Cited

U.S. PATENT DOCUMENTS

| | | | | |
|---|---|---|---|---|
| 6,110,248 | A | 8/2000 | Liu | |
| 6,113,663 | A | 9/2000 | Liu | |
| 6,115,881 | A * | 9/2000 | Hult et al. | 15/377 |
| 6,158,083 | A | 12/2000 | Holsten | |
| 6,428,589 | B1 | 8/2002 | Bair et al. | |
| 6,436,160 | B1 | 8/2002 | Stephens et al. | |
| 6,440,191 | B1 * | 8/2002 | Berfield et al. | 55/485 |
| 6,451,078 | B2 * | 9/2002 | Berfield et al. | 55/374 |
| 6,481,049 | B1 * | 11/2002 | Berfield | 15/353 |
| 6,532,621 | B2 | 3/2003 | Stephens et al. | |
| 6,692,639 | B1 | 2/2004 | Spearman et al. | |
| 6,829,804 | B2 | 12/2004 | Sepke | |
| 7,165,290 | B2 | 1/2007 | Martinez et al. | |
| 7,404,231 | B2 | 7/2008 | Kang | |
| 7,627,928 | B2 | 12/2009 | Crevling, Jr. et al. | |
| 7,644,469 | B2 | 1/2010 | Beers et al. | |
| 7,824,456 | B1 * | 11/2010 | Monson | 55/319 |
| 8,037,570 | B2 | 10/2011 | Phelan et al. | |
| 8,037,572 | B2 | 10/2011 | Phelan et al. | |
| 2001/0005983 | A1 * | 7/2001 | Berfield et al. | 55/368 |
| 2002/0088209 | A1 | 7/2002 | Stephens et al. | |
| 2004/0139573 | A1 | 7/2004 | Stephens et al. | |
| 2005/0071949 | A1 | 4/2005 | Martinez et al. | |
| 2006/0179601 | A1 | 8/2006 | Crevling, Jr. et al. | |
| 2006/0191099 | A1 * | 8/2006 | Fry et al. | 15/353 |
| 2007/0056136 | A1 | 3/2007 | Stephens et al. | |
| 2008/0115307 | A1 | 5/2008 | Phelan et al. | |
| 2008/0115311 | A1 | 5/2008 | Sheddy et al. | |
| 2008/0115316 | A1 | 5/2008 | Sheddy et al. | |
| 2008/0184517 | A1 | 8/2008 | Phelan et al. | |
| 2008/0189899 | A1 | 8/2008 | Beers et al. | |
| 2008/0225318 | A1 | 9/2008 | Murakami | |
| 2009/0007367 | A1 | 1/2009 | Archbold | |
| 2009/0094775 | A1 | 4/2009 | Beers | |
| 2009/0183336 | A1 | 7/2009 | Kunz et al. | |
| 2009/0282640 | A1 * | 11/2009 | Sang et al. | 15/347 |
| 2010/0000414 | A1 * | 1/2010 | Williams et al. | 96/226 |
| 2010/0139032 | A1 | 6/2010 | Tomasiak | |
| 2011/0308208 | A1 | 12/2011 | Herndon et al. | |
| 2012/0018429 | A1 * | 1/2012 | Claffy | 220/200 |

* cited by examiner 11
12
16
10
13
17
76
15
14

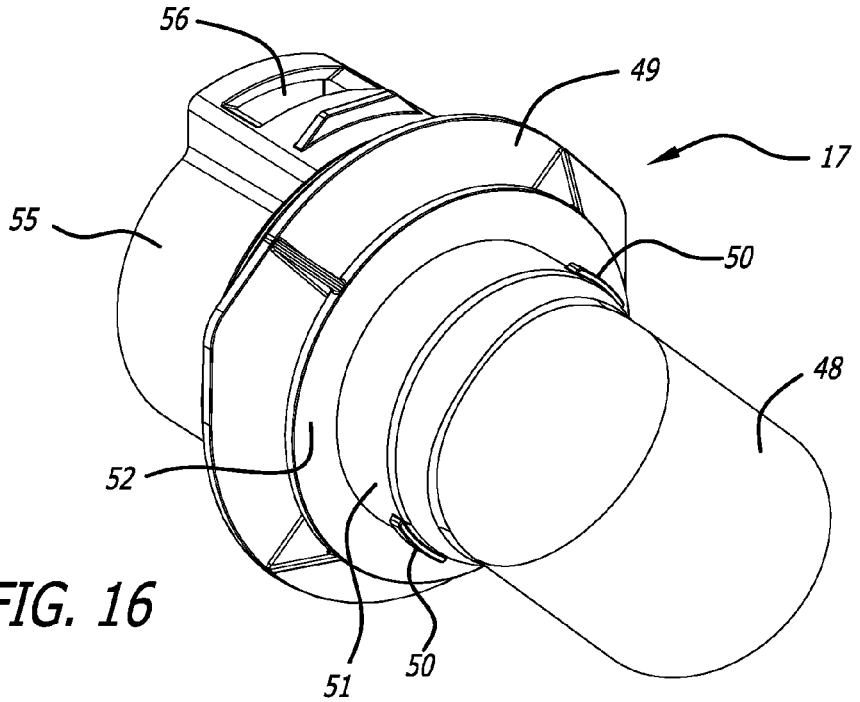
FIG. 16
FIG. 17
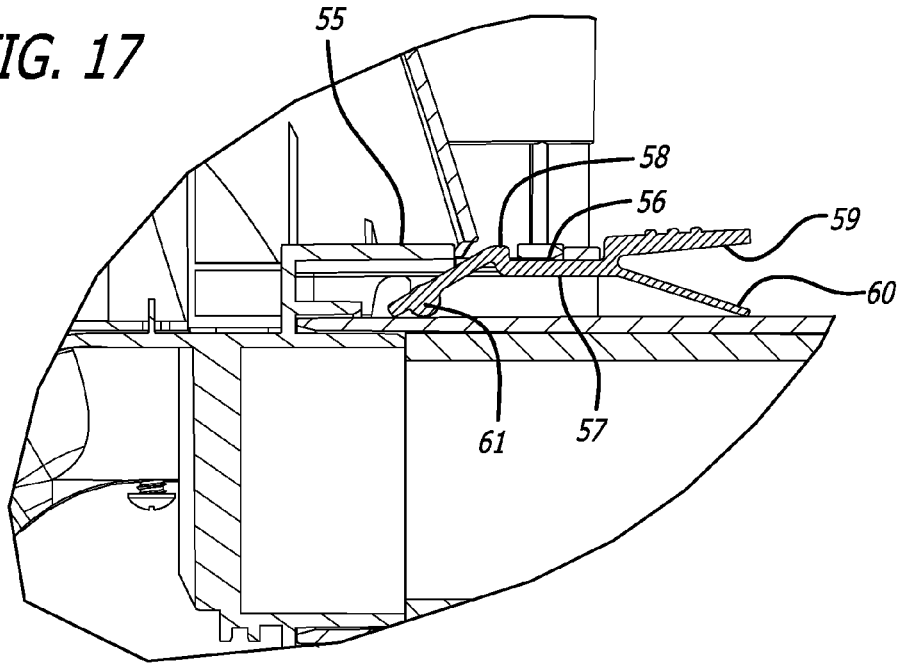

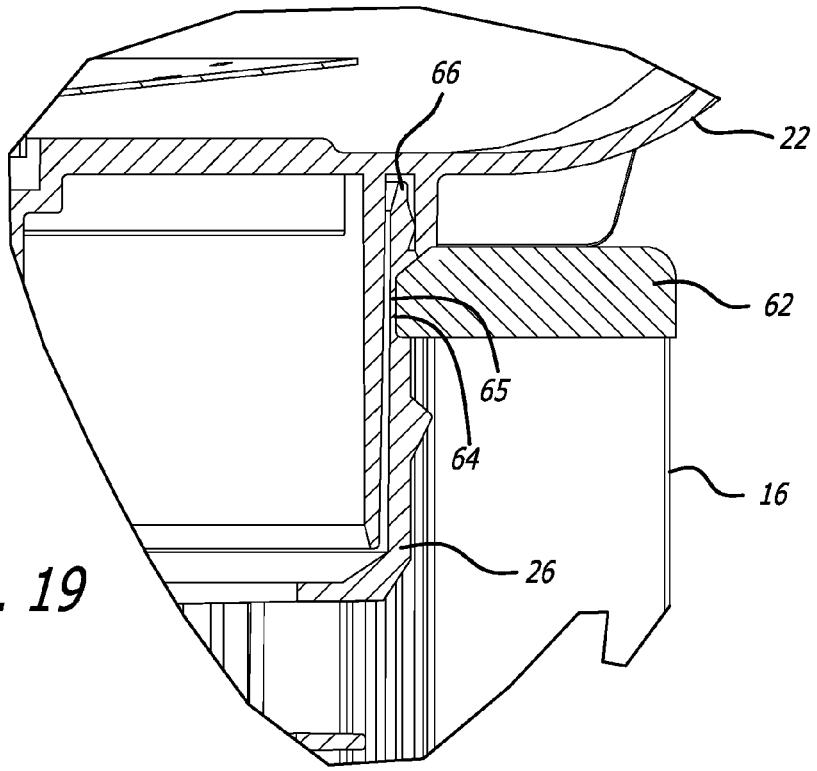
FIG. 19
FIG. 20
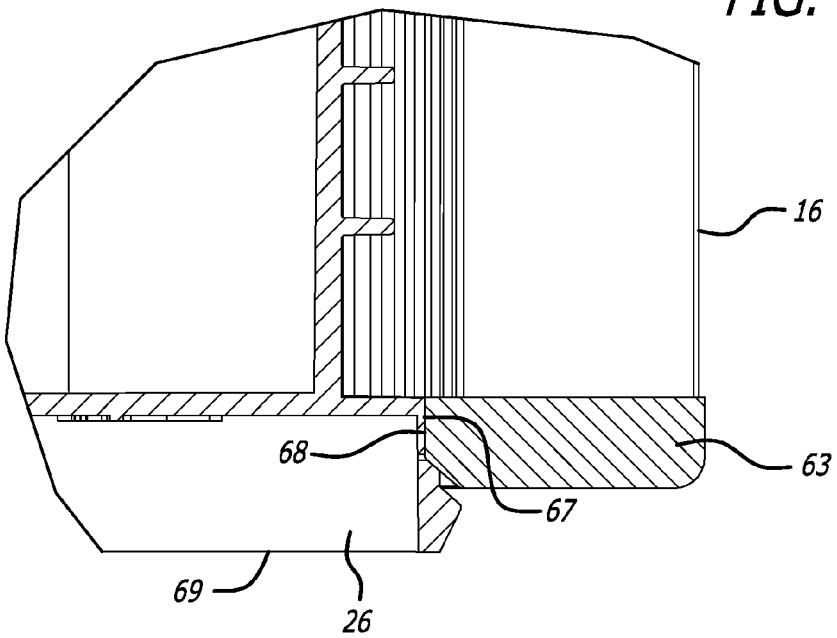

WET/DRY VACUUM CLEANER

BACKGROUND

1. Field of Invention

The invention relates to wet/dry vacuum cleaners, and, more particularly, to improvements in wet/dry vacuum cleaners.

2. Related Art

Vacuum appliances capable of picking up both wet and dry material, commonly referred to as wet/dry vacuums or wet/dry vacs, are well-known. Wet/dry vacs are often used in workshops and other environments where both wet and dry debris can accumulate.

Wet/dry vacs conventionally consist of a collection tank or canister, sometimes mounted on wheels or casters, and a cover or lid upon which a motor and impeller assembly is mounted. The motor and impeller assembly creates a suction within the canister, such that debris and liquid are drawn into the canister through an air inlet to which a flexible hose can be attached. A filter within the canister prevents incoming debris from escaping from the canister while allowing filtered air to escape. One example of a such a wet/dry vac is shown in U.S. Pat. No. 4,797,072.

Wet/dry vacs are commercially available in a variety of sizes and configurations. The capacity i.e., size, of a wet/dry vacuum collection canister, is typically measured in gallons. In many cases, the vacuum collection canister has a round or cylindrical configuration, since such a configuration represents the stablest pressure vessel, capable of withstanding the negative pressure (vacuum) forces that can be generated within a wet/dry vac.

SUMMARY OF THE INVENTION

The present invention is directed to a vacuum appliance having numerous features believed to be advantageous. In one embodiment, the vacuum is of the wet/dry variety.

One object of this invention is to provide a flat shape on the volute of the collector of the vacuum to improve the air flow performance.

Another object is to improve the shape of the tank of the vacuum to avoid collapsing problems due to suction of the vacuum cleaner.

Still another object of this invention is to combine the diffuser, which changes the direction of the air flow and liquids vacuumed by the vacuum cleaner, with both the usual filter bag support of such vacuum cleaners and the hose assembly support.

One important feature of such vacuum cleaners is to fix and seal the filter against the filter cage. It is an object of this invention to eliminate additional components to provide a good seal and improve the performance of the vacuum cleaner.

Finally, it is an object of this invention to provide a wet/dry vacuum cleaner with wheeled supports that do not require screws to keep in place and provide stronger support than in prior art assembles.

These and other objects are preferably accomplished by providing an improved wet/dry vacuum having all of the above features.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which:

FIG. 16 is a perspective view of the diffuser alone of FIG. 15;

FIG. 17 is a cross section view illustrating the hose connection to the diffuser.

FIG. 19 is a cross-sectional view of the upper end of the assembled cage, filter and collector of FIG. 18;

FIG. 20 is a cross-sectional view of the lower end of the assembled cage and filter of FIG. 18;

DETAILED DESCRIPTION OF INVENTION

Figure 1:
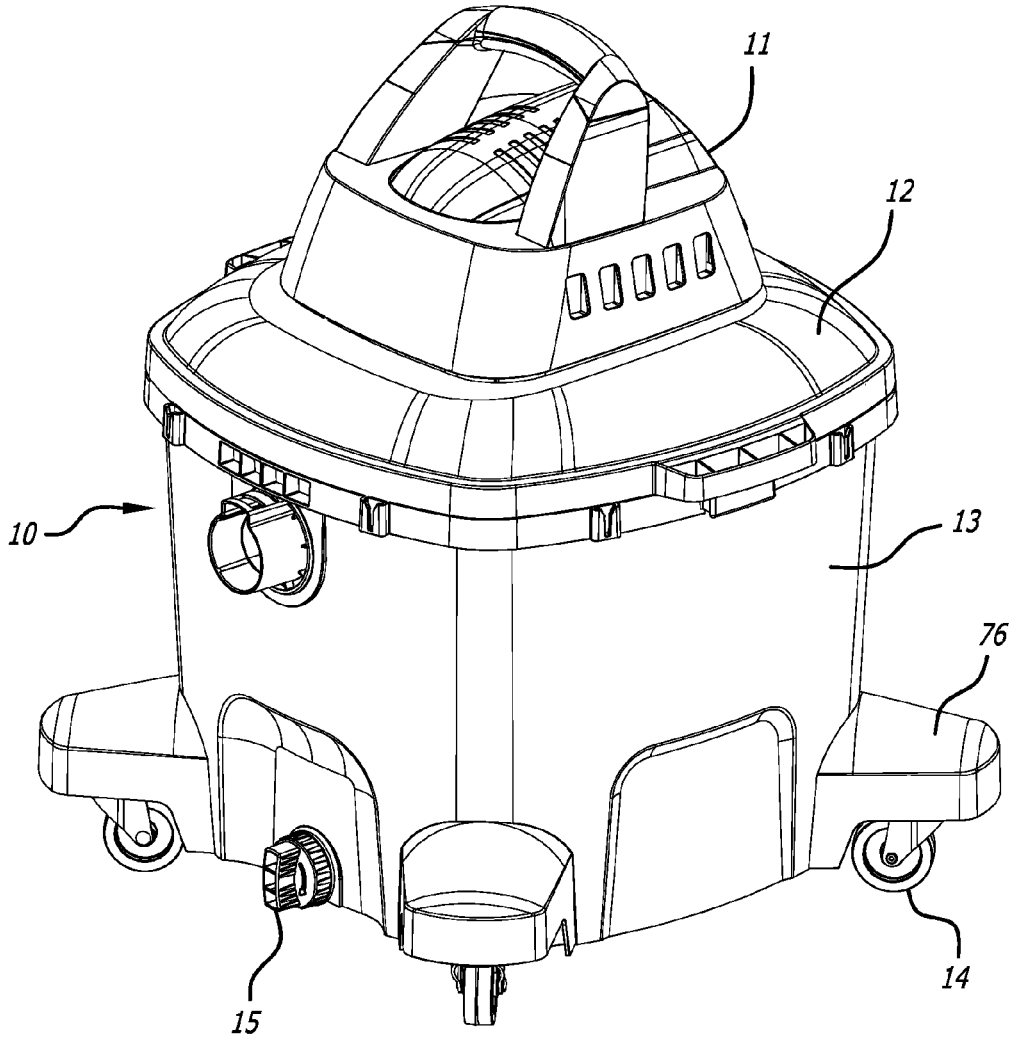
FIG. 1 is a perspective view of an assembled wet/dry vacuum in accordance with the teachings of the invention.

Referring now to the drawings, FIG. 1 shows an assembled wet/dry vacuum 10 having a motor cover 11 at top, a lid 12 and a tank 13. Wheels 14 are provided at bottom. A drain cap 15 is provided at the bottom of tank 13.

Figure 2:
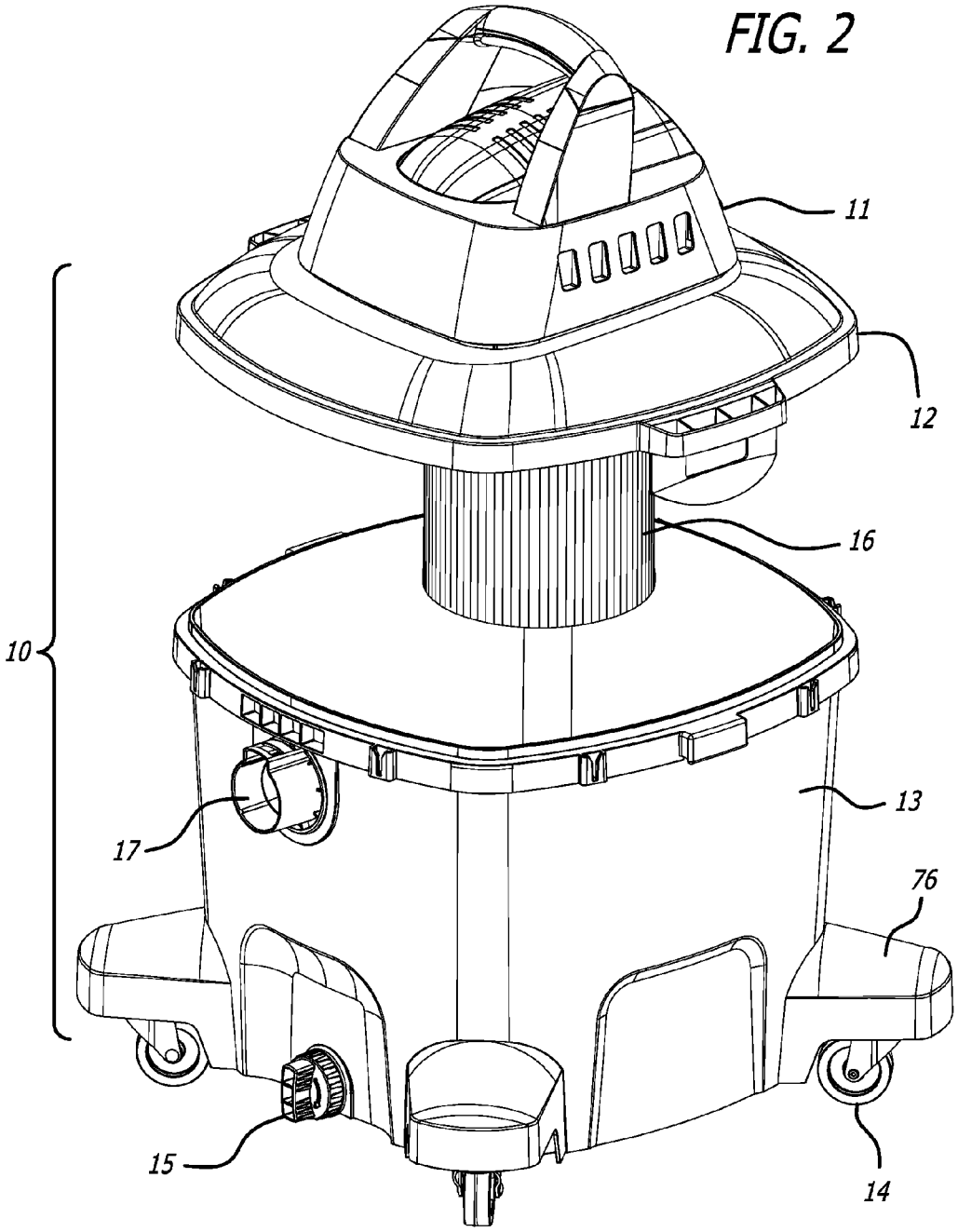
FIG. 2 is an exploded view of the vacuum of FIG. 1 showing the lid and filter prior to assembly to the tank of the vacuum cleaner.

As seen in FIG. 2, a pleated filter 16 is provided under lid 12. A diffuser 17 for attachment to a vacuum hose 18 (see FIG. 11) is provided communicating with the interior of tank 13.

Figure 3:
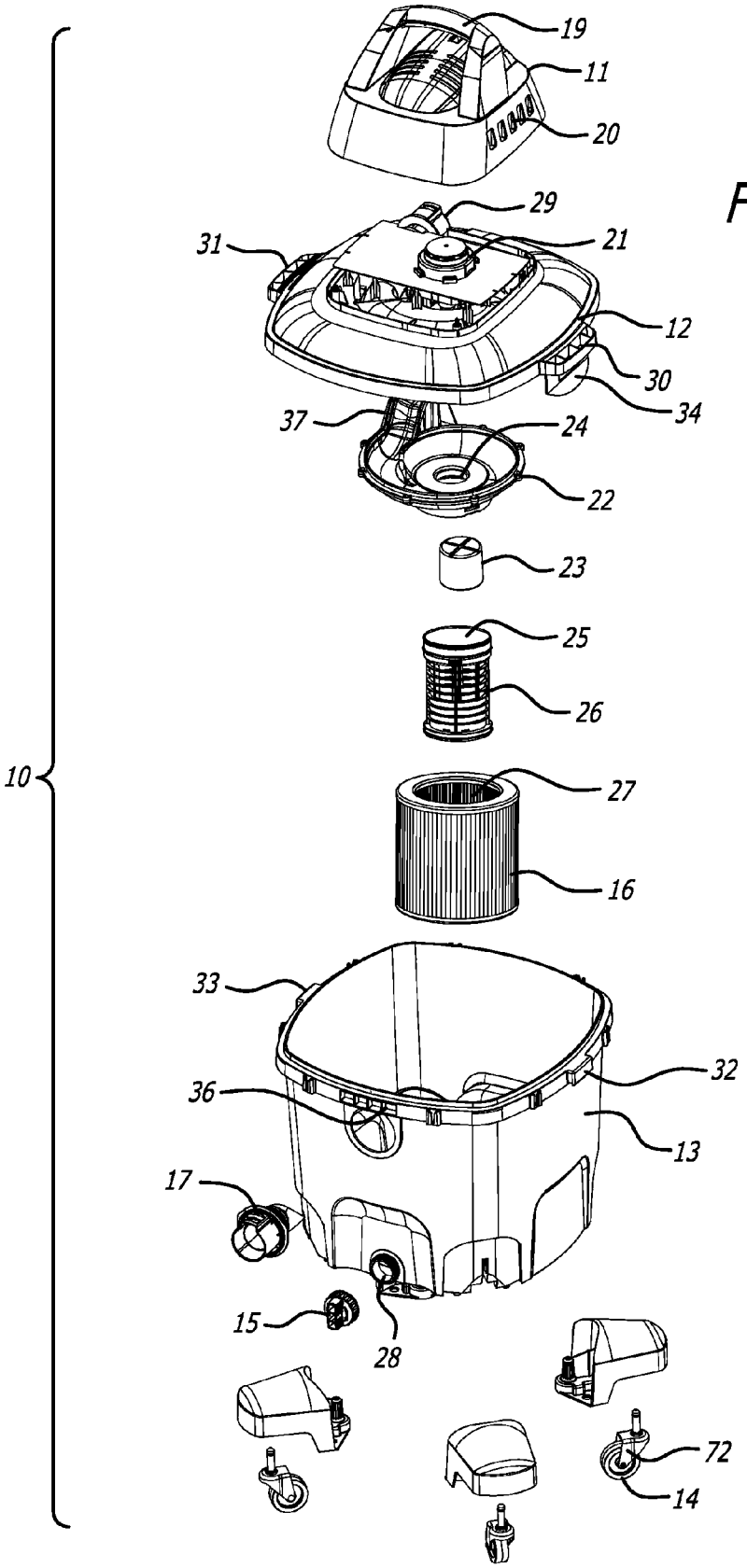
FIG. 3 is an exploded view of the wet/dry vacuum cleaner of FIG. 1.

As seen in FIG. 3, a molded handle 19 may be provided at the top of cover 11 with air vents 20. It is to be understood that lid 12 includes a conventional motor, impeller, and fan assembly 21 as is well known in the wet/dry vacuum art.

A collector 22 is provided between lid 12 and filter 16. A float 23 extends through opening 24 in collector 22 and into a throughbore 25 in filter cage 26 which cage 26 extends into through bore 27 in filter 16.

The parts 22, 23, 26 and 16 thus fit inside of tank 13 and are closed off by lid 12. Drain cap 15 is threaded to drain 28. An exhaust port 29 on lid 12 communicates with the interior of lid 12. Lid 12 also has latches 30, 31 on the exterior periphery thereof which mate with locking members 32, 33, respectively, on the exterior periphery of the upper end of tank 13 with release tabs 34 to release the same as is well known in the art.

Figure 4:
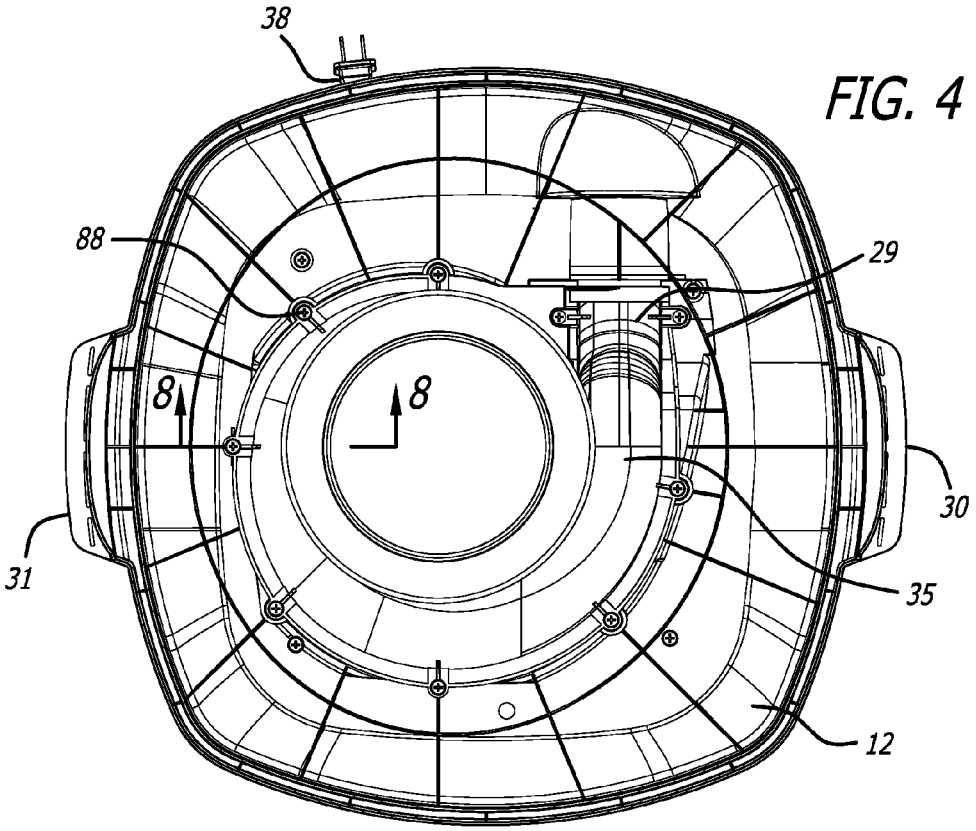
FIG. 4 is a bottom plan view of the underside of the lid of the vacuum cleaner of FIGS. 1 to 3.
Figure 5:
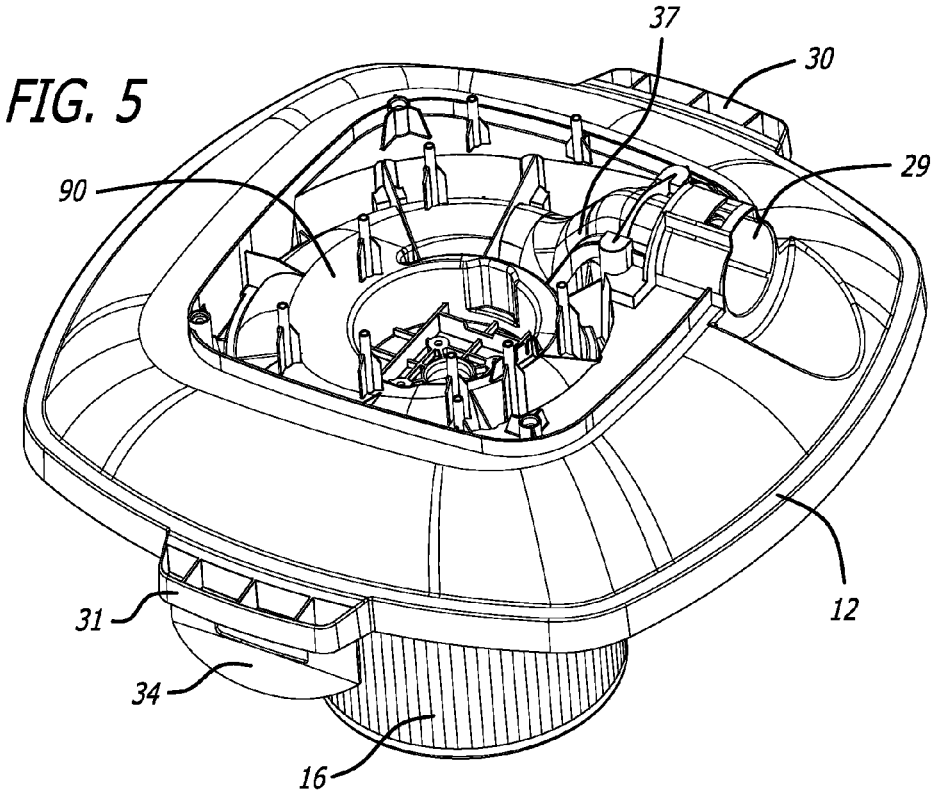
FIG. 5 is a perspective view of the lid and volute and filter alone of the vacuum cleaner of FIGS. 1 to 3.
Figure 7:
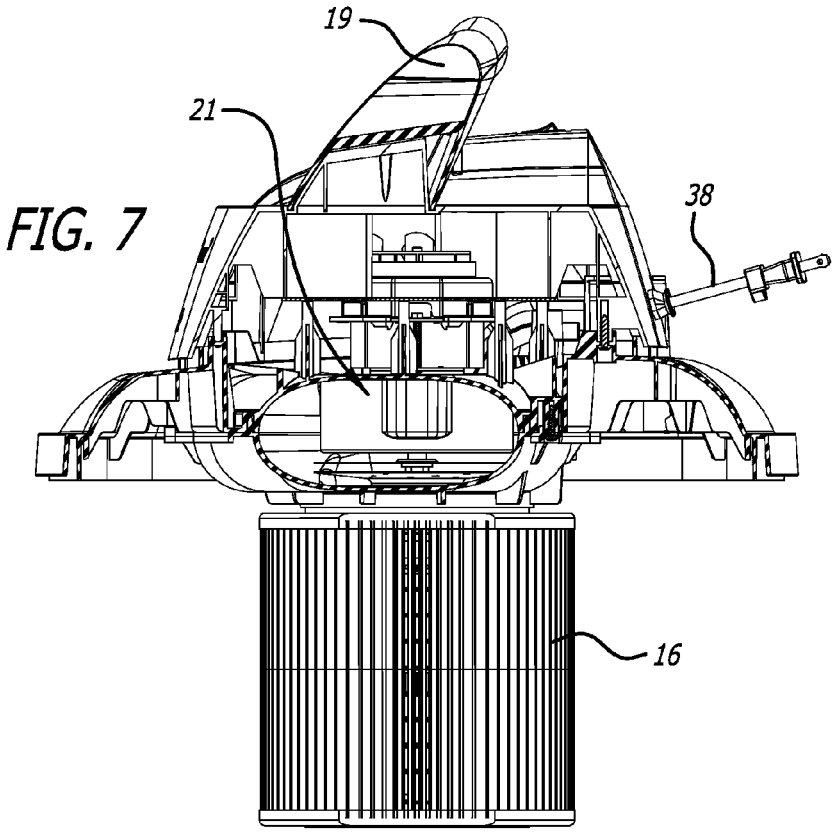
FIG. 7 is a cross-sectional view, partly in section, of the motor cover, motor, lid collector and filter of the assembled vacuum cleaner of FIG. 1.

As seen in FIGS. 4 and 5, the volute 35 disposed internally of lid 12 lying substantially in a horizontal plane. Volute 35 is thus formed of interconnected molded parts communicating, at one end with exhaust port 29, and at the other end with diffuser outlet 36 (FIG. 3). A curved portion 37 (FIG. 5) of volute 35 communicates with port 29. An electric plug 38 (see also FIG. 7) is coupled to the motor, impeller and fan assembly 21.

Thus, lid 12 (FIG. 3) is assembled against the collector 22 which is secured by suitable screw and mating threaded hole assemblies 88 (FIG. 4). In this way, both lid 12 and the collector 22 form a flat volute in order to accumulate the air flow of the vacuum cleaner 10 (FIG. 1). This flat shape is rounded all around and helps the air flow performance. The accumulated air flow inside the volute 35 which is generated by the impeller goes through the volute 35, and then to the exhaust port 29.

This flat shape of the volute 35 results in the same performance as prior art vacuums that use a volute with an increasing height therearound until the volute reaches the exhaust part.

Figure 6:
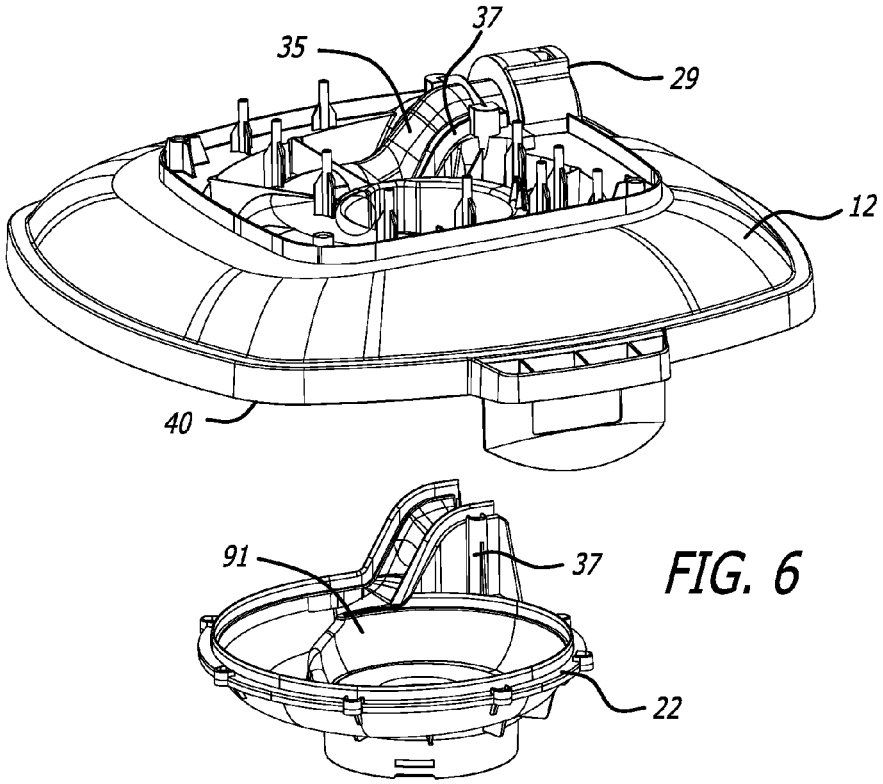
FIG. 6 is an exploded view of the lid and collector of the vacuum cleaner of FIGS. 1 to 3.
Figure 9:
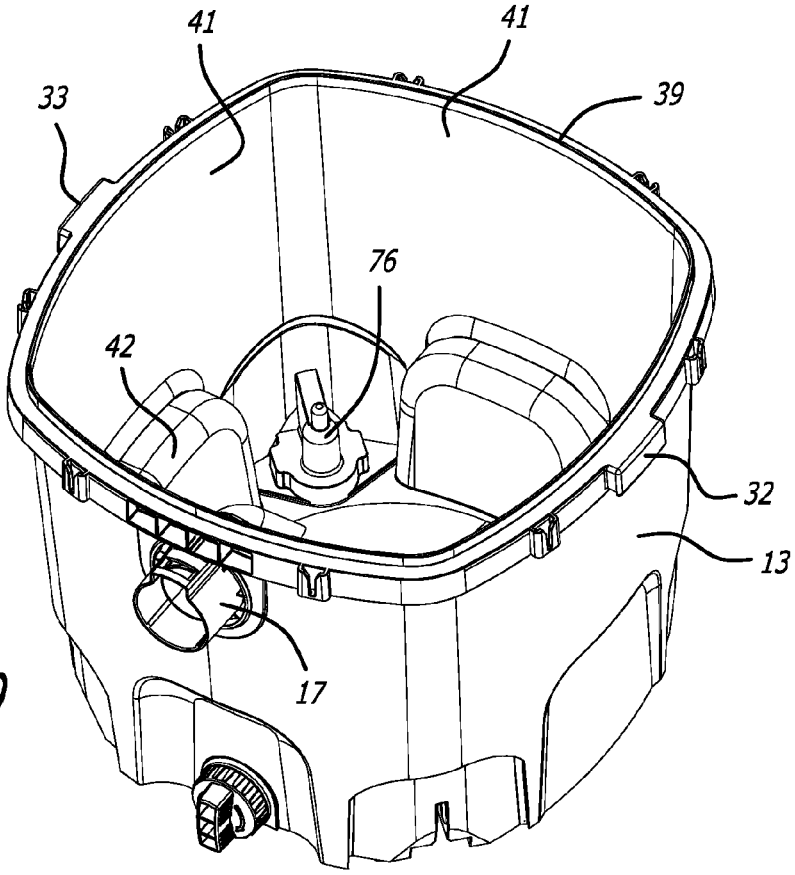
FIG. 9 is a perspective view of the tank alone of the vacuum cleaner of FIGS. 1 and 2 absent the wheel supports.

Referring now to FIG. 9, it can be seen that the tank 13 is square shaped in cross-section having an upper square-shaped peripheral rim 39 adapted to mate with a like shaped peripheral rim 40 of lid 12 (FIG. 6).

Figure 8:
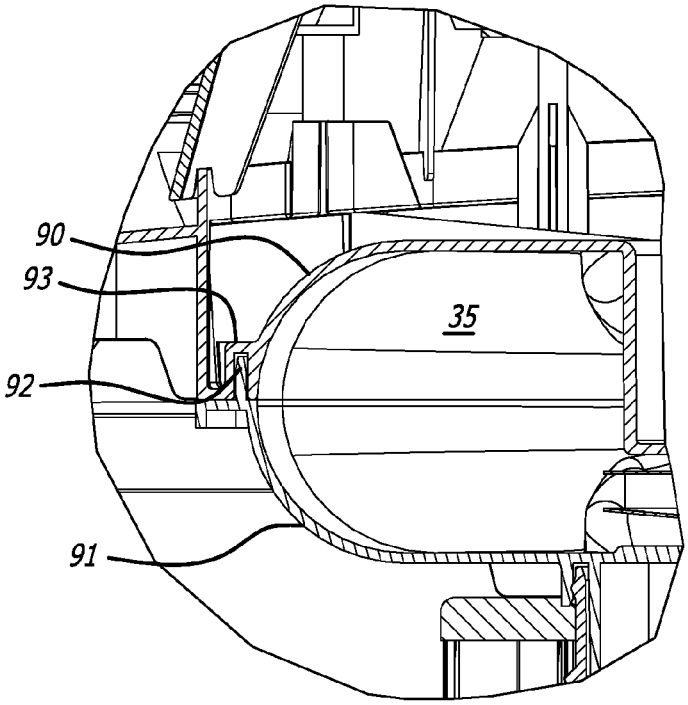
FIG. 8 is a view taken along line 8 of FIG. 4.

Volute 35 is formed by mating upper volute part 90 (FIG. 5) mating with lower volute part 91 (FIG. 6). FIG. 8 illustrates how a upstanding flange 92 on part 91 mates in a flanged slot 93 on lower volute part 90 to form a tight seal.

Figure 10:
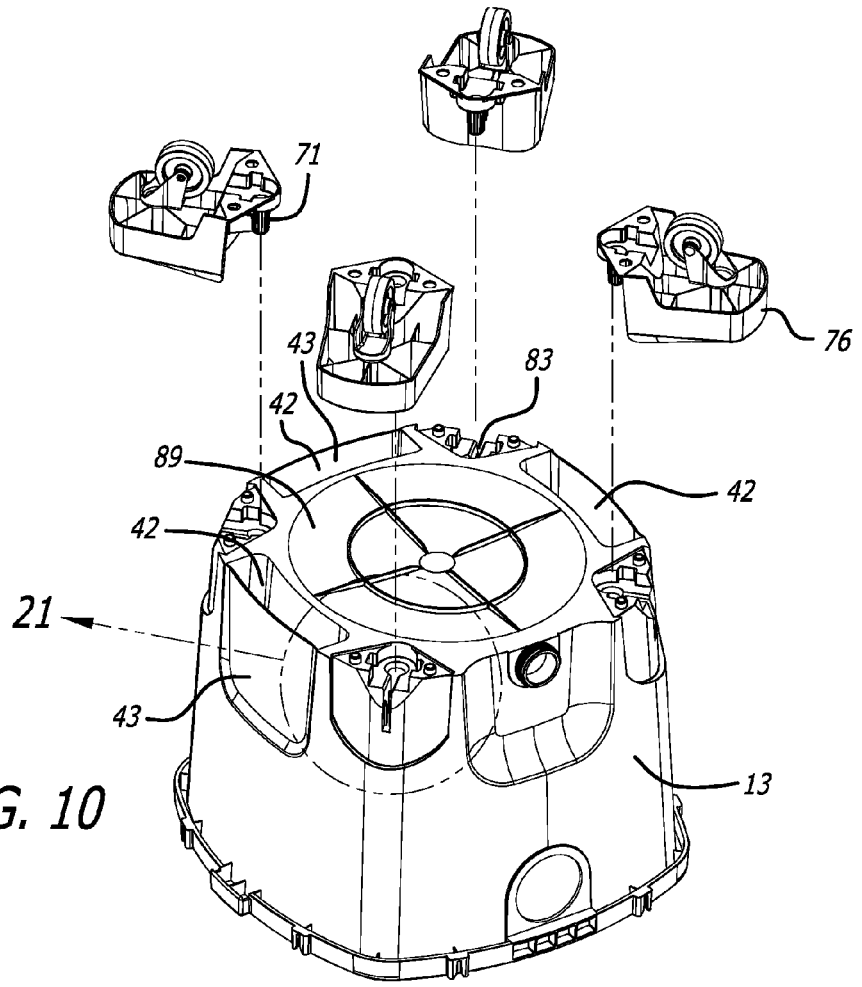
FIG. 10 is a bottom perspective view of the tank of FIG. 9 showing the wheel supports in exploded view prior to assembly.

As seen in FIG. 9, a recess area 42 is formed on each side flat wall 41 of tank 13. Thus, tank 13 has 4 upstanding walls extending from bottom wall 89 (FIG. 10). Comparing FIGS. 9 and 10, it can be seen that a recess area 42 is provided on the interior of side walls 41, of tank 13. The side walls not visible in FIG. 9 have similar recesses. See also FIG. 10. Each recess area 42 has an appearance wall 43 (see particularly FIG. 10) on the exterior to add to the overall look of the tank 13 and also make the tank 13 geometrically stronger.

Thus, tank 13 has a square shape avoiding the collapsing problems of prior art vacuums. Radiuses are provided in the vertical corners, and flat walls. The lid 12 has the same shape as the tank 13 in order to simplify the assembly between them.

The squared form on the lid 12 and the tank 13 maintain this shape even with a high suction level. The recess area 42 on each flat wall, and appearance wall 43, adds to the appearance of tank 13 and make the tank 13 geometry stronger.

Figure 12:
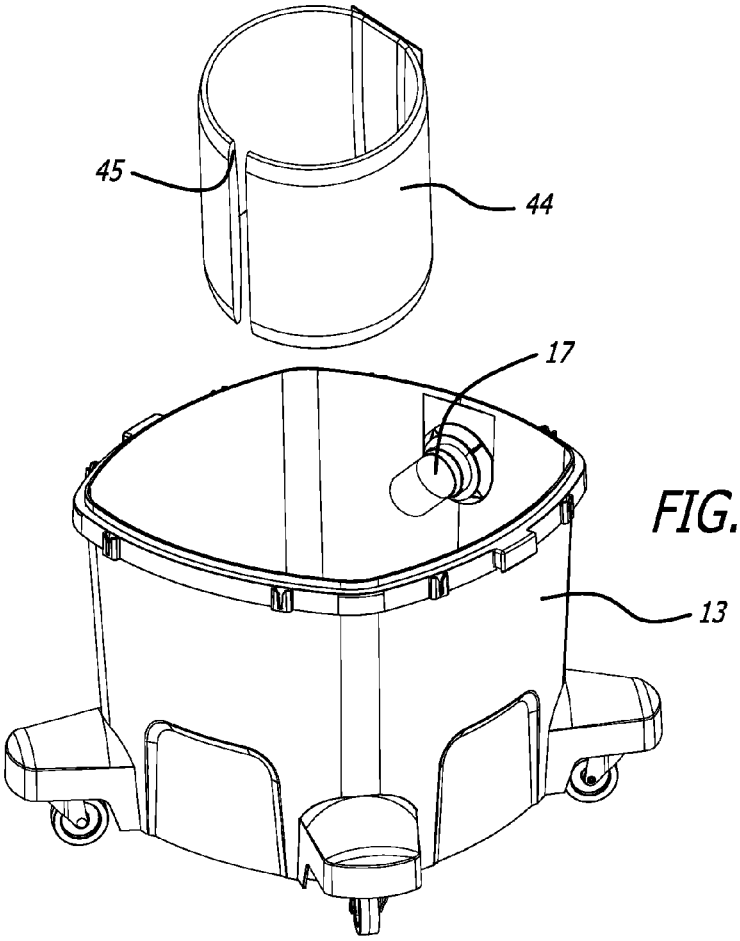
FIG. 12 is an exploded view of the tank of FIG. 11 showing the filter bag prior to assembly thereto.
Figure 13:
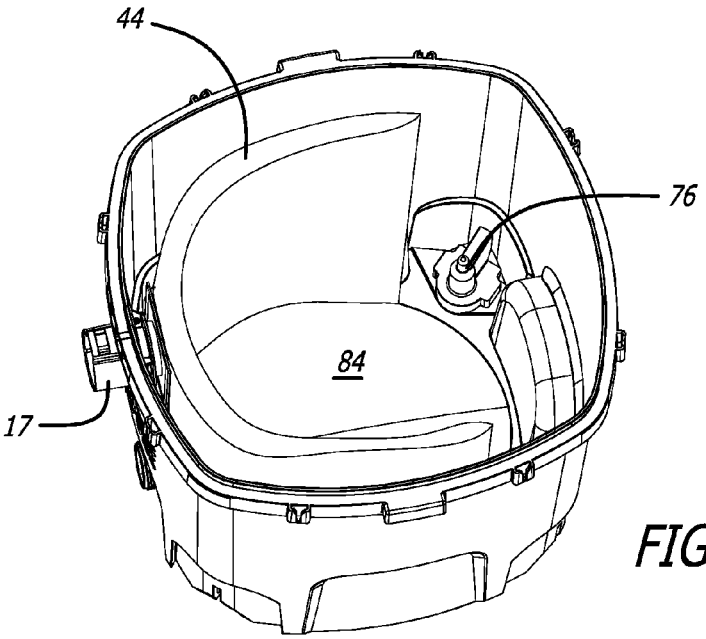
FIG. 13 is a perspective view of the tank of FIG. 3 showing the interior thereof.
Figure 14:
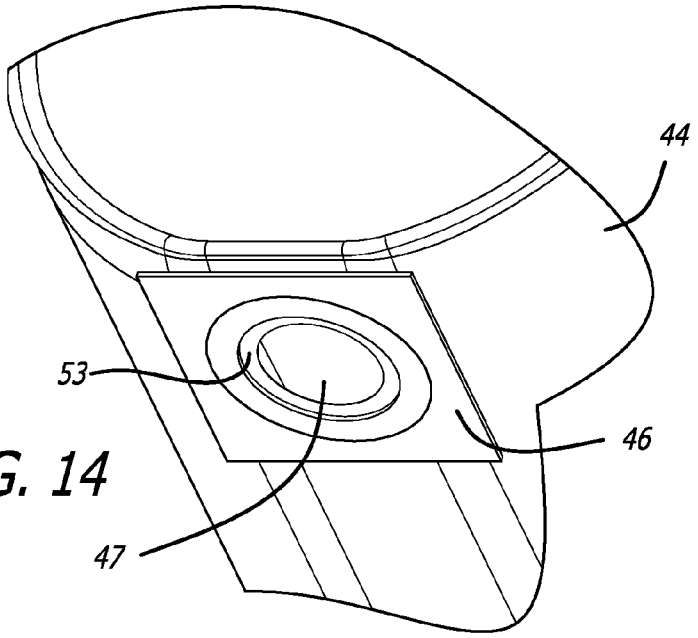
FIG. 14 is a detailed view of a portion of the filter bag of FIG. 12.

As seen in FIG. 12, a disposable filter bag 44 is provided having a slit 45 along one side. Bag 44, as seen in FIG. 14, has a square shaped seal 46 with an opening 47 there through. The diffuser 17 (FIG. 15) extends into opening 36 (FIG. 3) in tank 13 (FIG. 3) and through opening 47 in bag 44.

Figure 15:
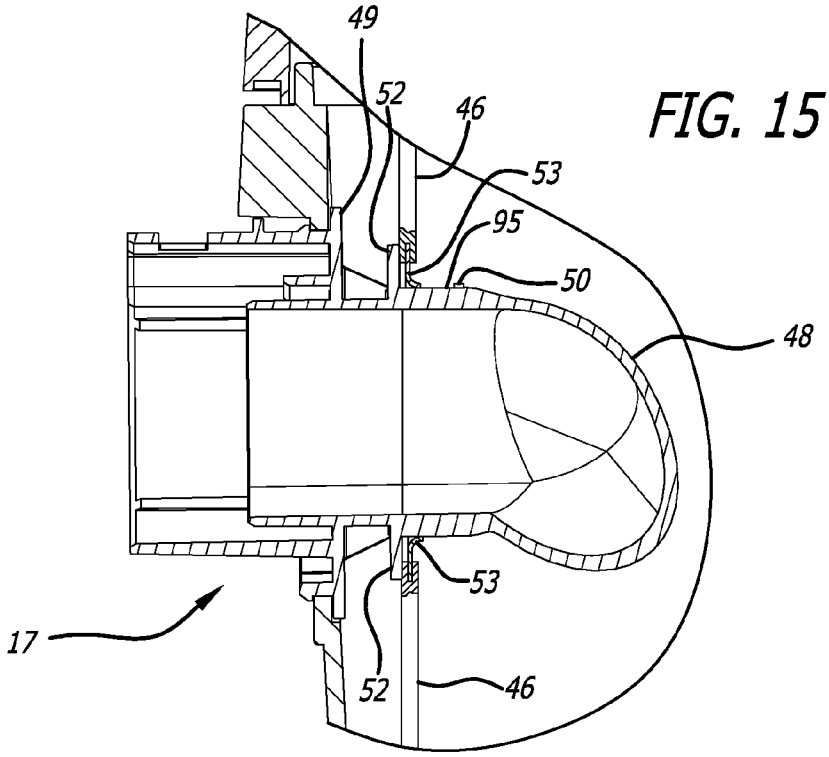
FIG. 15 is a view taken along line 15 of FIG. 11.

Diffuser 17 is shown in FIG. 16. Diffuser 17 has an elongated portion 48 (see also FIG. 15) extending from main body portion 49. A plurality such as 3, of spaced ribs 50 are provided on a tubular portion 51. Portion 48 extends through opening 36 (FIG. 3) with main body portion 49 (FIG. 15) abutting against the outer wall of tank 13 with portion 48 extending into the interior of tank 13 and through opening 47 in the seal 46 in filter bag 44, as seen in FIGS. 12 and 15. A rubber seal 53 surrounds opening 47 in filter bag 44 (FIG. 14) abuts against flange 52.

Figure 11:
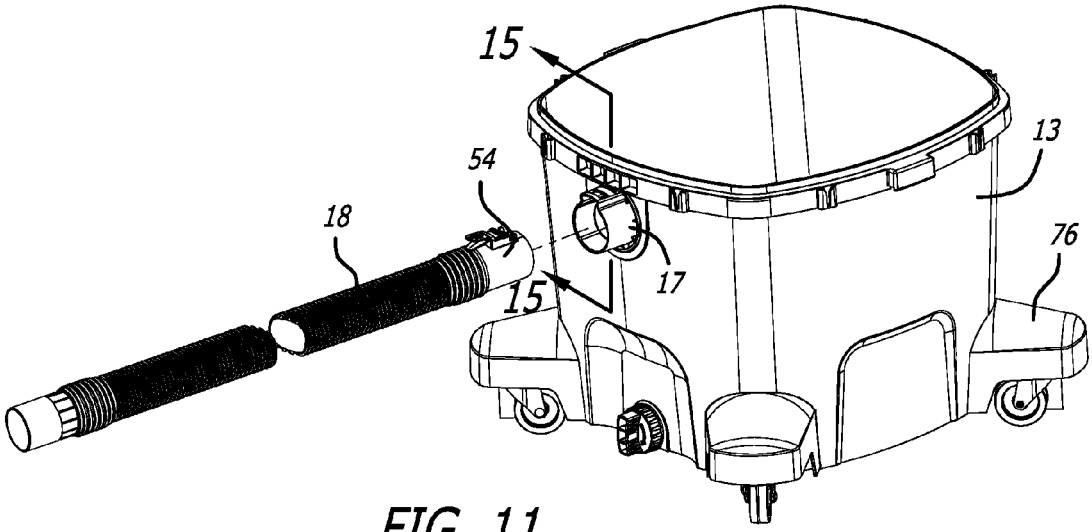
FIG. 11 is an exploded view of the tank of FIG. 10 with the wheel supports in place illustrating the attachment of a vacuum hose.

As seen in FIG. 11, vacuum hose 18 has a connector portion 54 which enters into and locks into tubular portion 55 of diffuser 17 (see FIGS. 16 and 17). A locking slot 56 is provided in tubular portion 55 (FIG. 16) and a latch 57 (FIG. 17) on connector portion 54 has a raised portion 58 which snaps into slot 56 as seen. The latch 57 can be released by actuation of resilient lever portion 59 to release hose 18 from tank 13. Pressing down on lever portion 59 against lower portion 60 moves portion 61 forwardly and raised portion 58 upwardly and out of slot 56. Hose 18 can thus be released from tank 13.

As is well known in the vacuum art, the diffuser 17 is used to change the direction of the air flow and liquids which are vacuumed by the vacuum 10. In this way it prevents dirt and water passing through the impeller. The diffuser 17 also is used as a filter bag support. Diffuser 17 has three small ribs 50 which lock the disposable filter bag 44, and keep it in place when a vacuum 10 is working. In order to seal the disposable filter bag 44 against the diffuser 17, the diffuser 17 has a flat round area which accepts the rubber seal 58 which is part is the disposable 44 filter bag. The diffuser 17 is thus used as a support for the hose assembly connector 54, in order to keep in position the hose assembly connector 54.

Thus, a simple diffuser 17 is used as a disposable bag support, and a hose assembly support, all in one component. In addition, this diffuser 17 can be fixed to the tank 13 without any need for screws or the like. It is mechanically fixed and no rubber or glue seal is needed.

Figure 18:
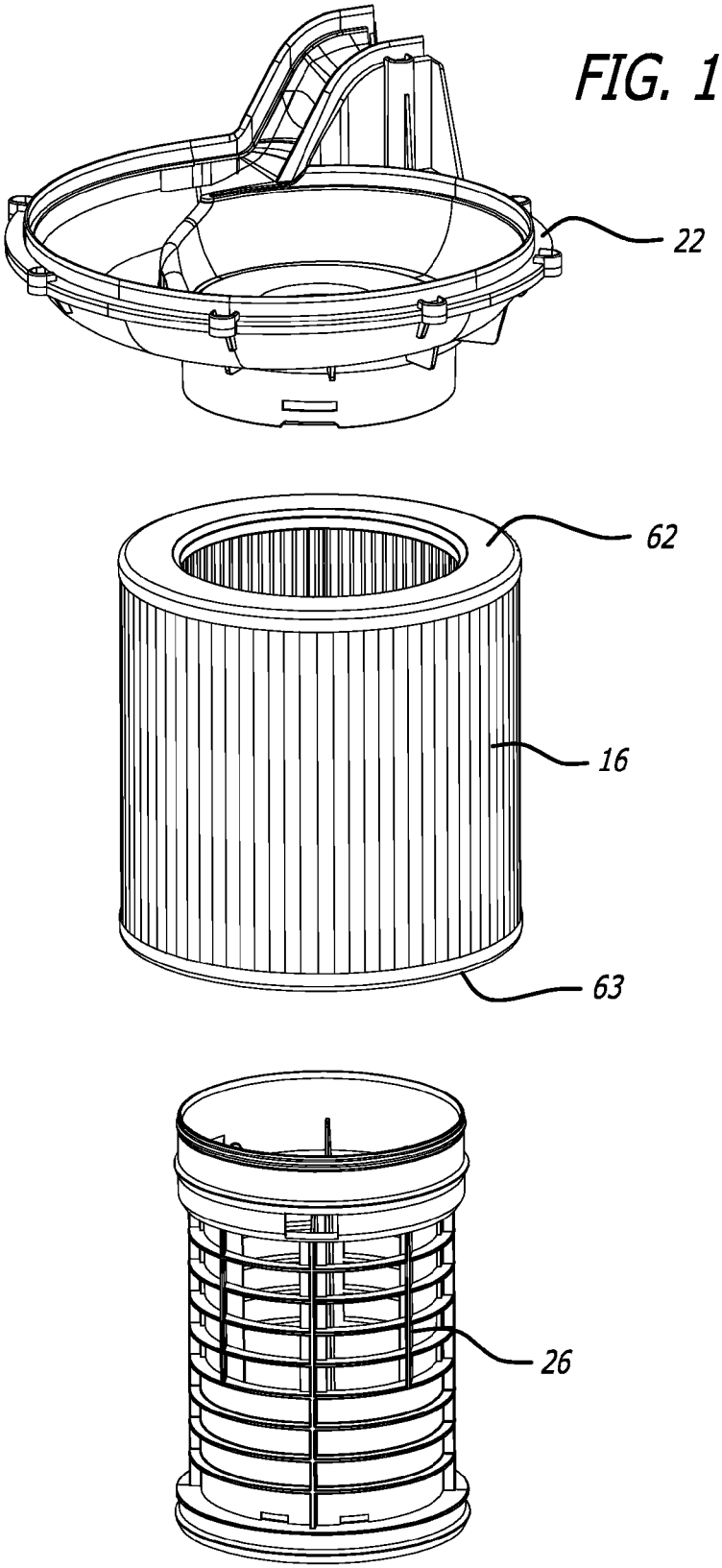
FIG. 18 is an exploded view of the filter, filter cage and collector of the vacuum cleaner of FIGS. 1 and 2.

The filter 16 and filter cage 26 are seen in FIG. 18. The filter 16 must be sealed against the filter cage 26. In order to make it easier to service vacuum 10, no additional components are used to fix and seal the filter 16 against cage 26. Filter 16 has upper and lower end caps 62, 63, respectively.

Preferably, these end caps 62, 63 are made of a suitable material, such as a soft urethane material. As seen in FIG. 19, end cap 62 has an internal lip 64 which seals against a rounded flat shaped portion 65 of the upper end 66 of filter cage 26. As seen in FIG. 20, the lower end cap 63 of filter 16 has an internal lip 67 which also seals against rounded flat shaped portion 68 of the lower end 69 of filter cage 26.

Thus, no additional components are needed to maintain the pleated filter 16 against the filter cage 26. The pleated filter 16 does need to be permanently pushed into place in order to seal against the filter cage 26. This concept seals in a radial way, so the internal diameter of the pleated filter 16 has interference against the filter cage 26 in order to warrant the best performance of the seal.

Figure 22:
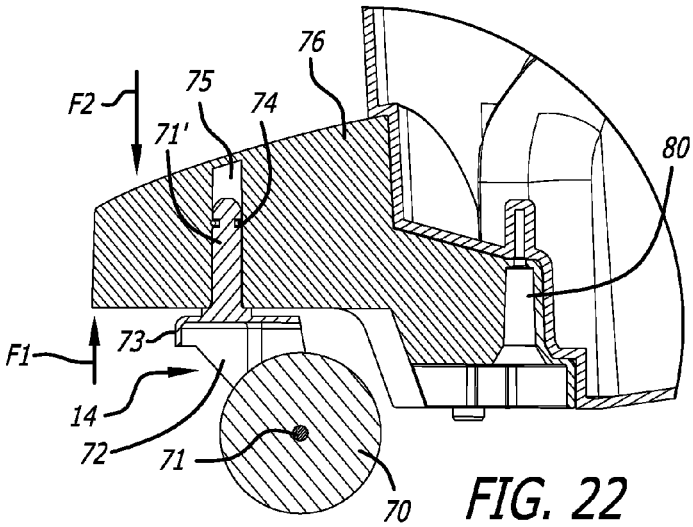
FIG. 22 is a detailed view of a wheel and its support attached to the tank of FIGS. 9 to 13.

Each of the wheels 14 (FIG. 3) have rotatable wheel elements 70 (FIG. 22) having an axle 71, mounted in a yoke portion 72 (FIG. 3) of a wheel housing 73 (FIG. 22). A ridged shaft 71' (see FIG. 22) extends into hole 75 and may have biased locking elements 74 (FIG. 22) for locking shafts 71, in mating holes 75 in wheel supports 76.

Figure 23:
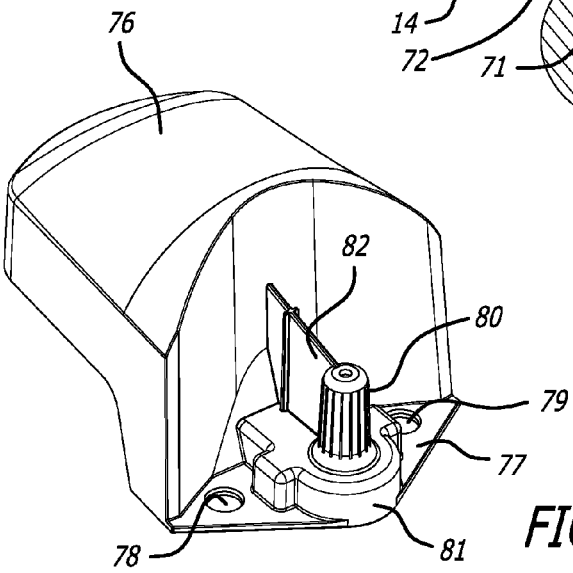
FIG. 23 is a perspective view of one of the wheel supports on the tank of FIGS. 9 to 13 illustrating coupling of the wheel thereto.

Each wheel support 76 (FIG. 23) has a flange 77 with spaced holes 78, 79 on each side of a splined upwardly extending shaft 80 mounted on a boss 81 integral with flange 77. A vertically extending generally flat rib 82 extends upwardly from boss 81 connected to shaft 80.

Tank 13 has at its bottom four recessed areas 83 (see FIG. 10) into which four wheel supports 76 are mounted.

Figure 21:
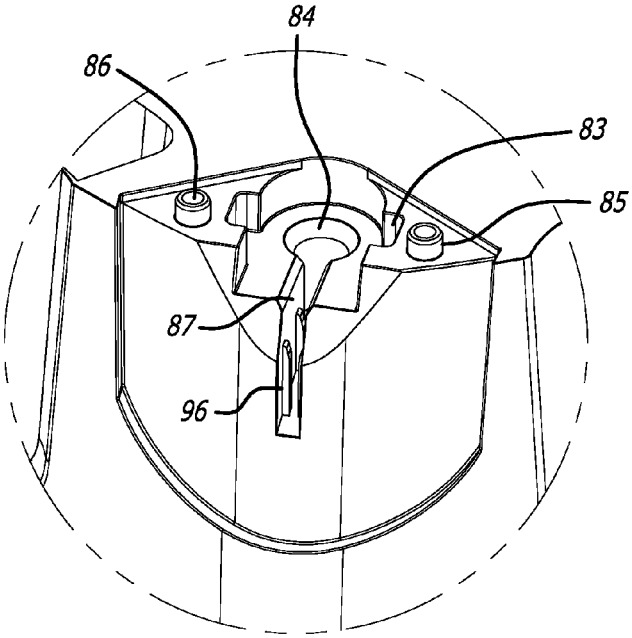
FIG. 21 is view taken along line 21 of FIG. 10.

As seen in FIG. 21, each recessed area 83 has a hole 84 adapted to receive shaft 80 therein and bosses or cylindrical ribs 85, 86 on each side of hole 84 entering holes 78, 79, respectively, when wheel support 76 is mounted in recessed area 83. A slot 87 extends from hole 84 and rib 82 enters into slot 87, a plurality of ribs 96 on each side wall of slot 87 assisting in maintaining the ribs 82 therein. The final assembled position of wheel support 76 in recess 83 is shown in FIG. 22.

It can be seen that there is disclosed a method and apparatus for preventing cracked wheel supports on a wet/dry vacuum. No tools are required to disassemble the wheels when servicing. The cylindrical ribs 85, 86, added to the tank 13, and two holes 78, 79, added to the wheel support 76, accomplished this. The function of these two cylindrical ribs 85, 86 prevent cracked or blended wheels supports when a force F1 (FIG. 22) is applied in an upwards direction. The four vertical ribs 96, and two vertical ribs 85, 86 are added to the tank 13. The function of these four vertical ribs prevents cracked or blended wheels supports (76) when a force F2 (FIG. 22) is applied in downwards direction. In this way, the displacement in the upwards or downwards direction gets locked. In addition to improving the appearance in the connection between the wheel support 76, and the tank 13, the recess area 83 was added on each corner where the wheel supports are mounted. In this way, the end user never see a gap because of the manufacturing processes.

The assembled wheels supports 76 against the tank 13 is stronger than prior art assemblies and is capable of withstanding abnormal use. In addition, the assembly between the tank 13 and the wheel supports 76 does not require screws to keep the wheel support 76 in place.

Although a particular embodiment of the invention is disclosed, variations thereof may occur to an artisan and the scope of the invention should only be limited by the scope of the appended claims.

The invention claimed is:

1. In a wet/dry vacuum cleaner having a cover closing off the upper end of the vacuum cleaner, a lid connected to the cover having a collector extending into the lid and a filter assembly extending downwardly from the collector into a water tank, said lid having a volute for the vacuum cleaner communicating with a exterior thereof, said volute for said vacuum cleaner being disposed internally of said lid and coupled to an exhaust port, said volute being generally horizontally mounted in said lid forming a flat volute for accumulating air flow, wherein said filter assembly includes a pleated filter having a throughbore with a filter cage mounted in said throughbore, said filter having peripheral end caps at the upper and lower ends thereof, said upper end cap having an inward and upwardly extending peripheral tapered lip at the upper end thereof, and said lower end cap having an inward and downwardly extending peripheral tapered lip at the lower end thereof, said filter cage having an upper peripheral rim, and a lower peripheral rim, said upper peripheral rim of said filter cage having a outwardly and downwardly extending tapered lip engaging the inward and upwardly extending peripheral tapered lip at the upper end of said filter, and said lower peripheral rim of said filter cage having an outwardly and upwardly extending tapered lip engaging the inward and downwardly extending peripheral lip at the lower end of said filter.

2. The vacuum cleaner of claim 1 wherein said volute has a curved portion extending to said exhaust port.

3. The wet/dry vacuum cleaner of claim 1 wherein said water tank is square shaped in cross-section having an upwardly extending square-shaped peripheral rim, said lid having a square shaped peripheral rim conforming to the square-shaped peripheral rim of said tank.

4. The vacuum cleaner of claim 3 wherein said tank has four interconnected outer walls extending upwardly from a bottom wall, a recessed area formed in the interior of tank at the lower end of each outer wall extending from the outside of said tank into the interior thereof and through said bottom wall, each recessed area being closed off on the outside thereof by an appearance wall generally flush with the respective outer wall of said tank.

5. The vacuum cleaner of claim 1 wherein each of said end caps of said filter is of a soft urethane material.

6. In a wet/dry vacuum cleaner having a cover closing off the upper end of the vacuum cleaner, a lid connected to the cover having a collector extending into the lid and a filter assembly extending downwardly from the collector into a water tank, said lid having a volute for the vacuum cleaner communicating with a exterior thereof, said volute for said vacuum cleaner being disposed internally of said lid and coupled to an exhaust port, said volute being generally horizontally mounted in said lid forming a flat volute for accumulating air flow, wherein said tank has a plurality of spaced wheel support assembles at the bottom thereof, each of said wheel support assembles including a rotatable wheel journalled for rotation in a wheel support, each of said wheel supports having a shaft mounted thereon, and a mounting hole on each side of said shaft, and said tank having a wheel support recess area at the lower end thereof, each wheel support recess area being adapted to receive a respective wheel support therein, and a generally flat upstanding rib on said wheel support extending inwardly from said wheel support shaft, each of said wheel support recesses having a slot for receiving said rib therein and a hole for receiving said wheel support shaft, and a pair of bosses on each side of said hole for entering the holes in each of said wheel supports.

7. In a wet/dry vacuum cleaner having a cover closing off the upper end of the vacuum cleaner, a lid connected to the cover having a collector extending into the lid and a filter assembly extending downwardly from the collector into a water tank, said lid having a volute for the vacuum cleaner communicating with a exterior thereof, said volute for said vacuum cleaner being disposed internally of said lid and coupled to an exhaust port, said volute being generally horizontally mounted in said lid forming a flat volute for accumulating air flow, wherein said filter assembly includes a pleated filter having a throughbore with a filter cage mounted in said throughbore, said filter having peripheral end caps at the upper and lower ends thereof, said upper end cap having an inward and upwardly extending peripheral tapered lip at the upper end thereof, and said lower end cap having an inward and downwardly extending peripheral tapered lip at the lower end thereof, said filter cage having an upper peripheral rim, and a lower peripheral rim, said upper peripheral rim of said filter cage having a outwardly and downwardly extending tapered lip engaging the inward and upwardly extending peripheral tapered lip at the upper end of said filter, and said lower peripheral rim of said filter cage having an outwardly and upwardly extending tapered lip engaging the inward and downwardly extending peripheral lip at the lower end of said filter, a diffuser mounted on said tank for changing the direction of air flow and liquids vacuumed by said vacuum cleaner, said diffuser extending out of said tank and having a filter bag lock thereon adapted to engage an opening in a seal in a disposable filter bag and lock said bag to said diffuser, said diffuser also having a hose lock on the portion thereof extending out of said tank locking the connector portion of a vacuum cleaner hose thereto.

8. In a wet/dry vacuum cleaner having a cover closing off the upper end of the vacuum cleaner, a lid connected to the cover having a collector extending into the lid and a filter assembly extending downwardly from the collector into a water tank, said lid having a volute for the vacuum cleaner communicating with a exterior thereof, said volute for said vacuum cleaner being disposed internally of said lid and coupled to an exhaust port, said volute being generally horizontally mounted in said lid forming a flat volute for accumulating air flow, wherein said tank has a plurality of spaced wheel support assembles at the bottom thereof, each of said wheel support assembles including a rotatable wheel journalled for rotation in a wheel support, each of said wheel supports having a shaft mounted thereon, and a mounting hole on each side of said shaft, and said tank having a wheel support recess area at the lower end thereof, each wheel support recess area being adapted to receive a respective wheel support therein, and a generally flat upstanding rib on said wheel support extending inwardly from said wheel support shaft, each of said wheel support recesses having a slot for receiving said rib therein and a hole for receiving said wheel support shaft, and a pair of bosses on each side of said hole for entering the holes in each of said wheel supports, a diffuser mounted on said tank for changing the direction of air flow and liquids vacuumed by said vacuum cleaner, said diffuser extending out of said tank and having a filter bag lock thereon adapted to engage an opening in a seal in a disposable filter bag and lock said bag to said diffuser, said diffuser also having a hose lock on the portion thereof extending out of said tank locking the connector portion of a vacuum cleaner hose thereto.

* * * * *